United States Patent [19]

Mulderrig

[11] 3,934,292

[45] Jan. 27, 1976

[54] TRIGGERING DEVICES

[75] Inventor: Ciaran Joseph Mulderrig, London, England

[73] Assignee: BOC Limited, London, England

[22] Filed: Mar. 27, 1975

[21] Appl. No.: 562,647

[30] Foreign Application Priority Data

Apr. 3, 1974 United Kingdom ..... 14809/74

[52] U.S. Cl. ..... 9/318; 137/67; 222/5

[51] Int. Cl.[2]... B63C 9/18; F16K 17/14; B67B 7/28

[58] Field of Search ..... 9/314, 316–327; 222/5, 52; 137/67; 102/10, 16

[56] References Cited

UNITED STATES PATENTS

| | | | |
|---|---|---|---|
| 2,894,658 | 7/1959 | Spidy | 09/317 X |
| 3,015,414 | 1/1962 | Wilson | 222/5 |
| 3,048,303 | 8/1962 | Spidy et al. | 222/5 |
| 3,266,668 | 8/1966 | Davis | 222/5 |
| 3,812,546 | 5/1974 | Witte | 09/319 |

*Primary Examiner*—Trygve M. Blix
*Assistant Examiner*—Sherman D. Basinger
*Attorney, Agent, or Firm*—Dennison, Dennison, Meserole & Pollack

[57] ABSTRACT

A triggering device intended to be actuated upon being immersed in water uses a force-transmitting member of variable length in the form of an array of collapsible struts restrained from folding, and hence triggering the device by at least one tensile member of which the strength reduces greatly when wetted.

10 Claims, 4 Drawing Figures

TRIGGERING DEVICES

This invention relates to triggering devices, particularly for inflatable bodies which are automatically inflated by the triggering device on coming into contact with water.

Occupants of aeroplanes are frequently equipped with inflatable flotation devices so that if, in an emergency, they have to escape from the aircraft into the sea or other waters, they can inflate the devices and be kept afloat while waiting to be rescued. Unfortunately, people are sometimes unconscious when they enter the water and are therefore unable to initiate the inflation of their devices. Such devices usually include a container of pressurised gas which can be released by means of an actuator to cause the gas to provide inflation. The actuator could be connected to a part of the aeroplane so that it is triggered when the occupant has made his exit or, in some cases, separated from his seat. However, this has the disadvantage that the triggering device might easily be actuated by excessive movement of the occupant, leading to the device inflating when not needed. In a subsequent emergency the occupant might be unable to leave the aircraft because of the excessive volume of the inflated device.

It is the aim of the present invention to provide a triggering device which is automatically actuated within a few seconds of coming into contact with water.

Accordingly the present invention provides an immersion-actuated triggering device which is as claimed in the appended claims.

The present invention will now be described by way of example with reference to the accompanying drawings, in which.

Figure 1:
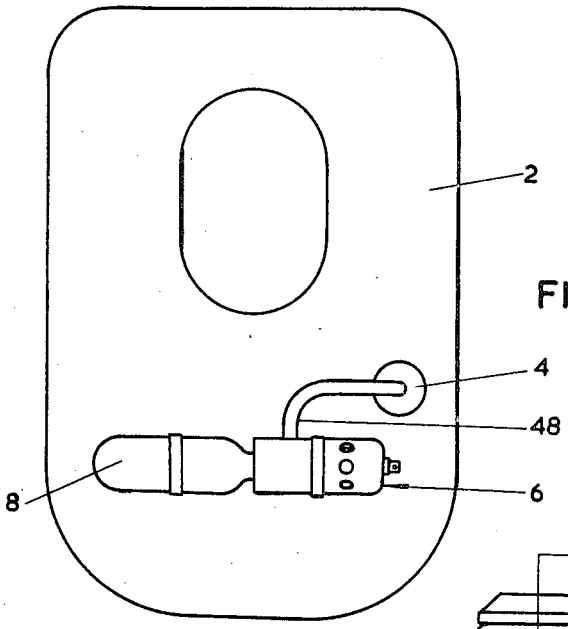
FIG. 1 is a diagrammatic view of an inflatable life jacket fitted with a triggering device of the present invention.
Figure 3:
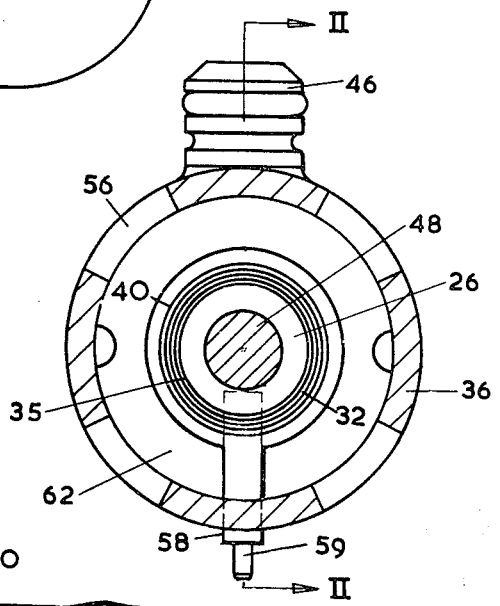
FIG. 3 is a section on the line III—III of FIG. 2.

FIG. 1 shows a life jacket 2 having a gas inlet 4 connected to the outlet of a triggering device indicated diagrammatically at 6, the device, when actuated, serving to allow gas under pressure to enter, and inflate, the life jacket 2 from a capsule 8 containing gas under pressure. It will be appreciated that the life jacket shown in FIG. 1 is not drawn in the position and shape in which it would be when worn by a aviator or other wearer. For clarity of illustration the means usually provided to secure the life jacket 2 to the body of the wearer have been omitted.

Figure 2:
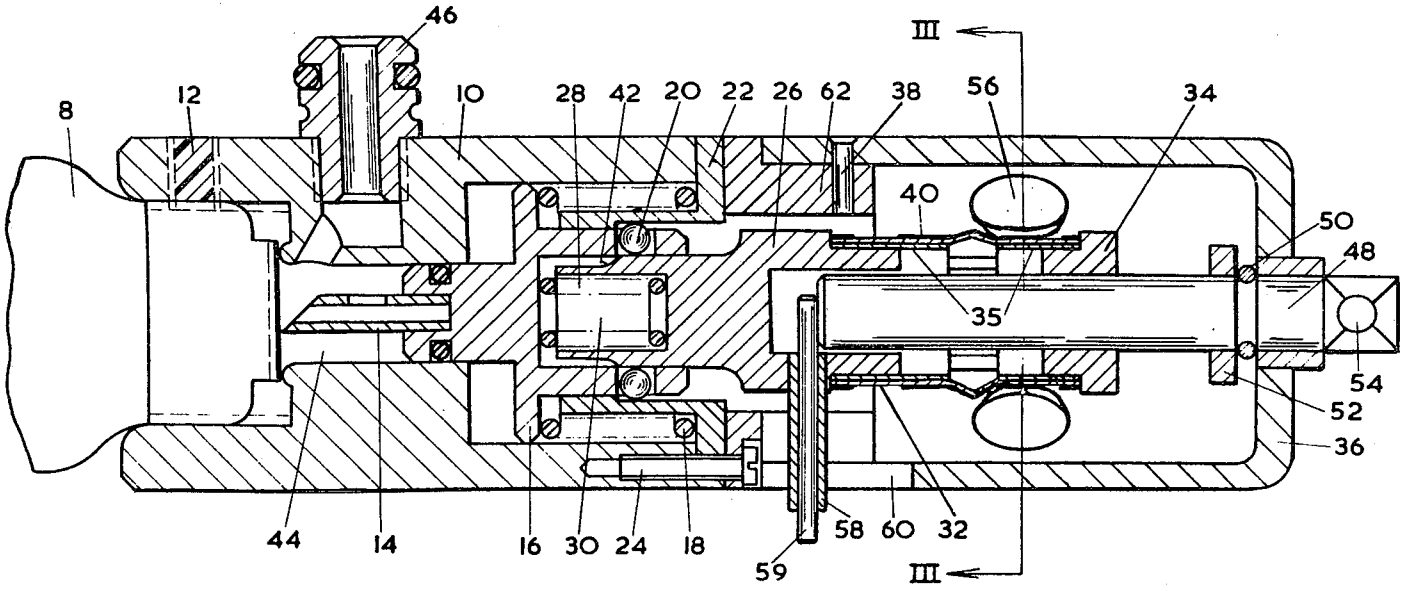
FIG. 2 shows a section through a triggering device of the present invention.

As shown more clearly in FIG. 2, the capsule 8 containing carbon dioxide or other gas under pressure is secured to one end of a housing 10, being locked there against inadvertent removal by means of a grub screw 12 of plastics material able to engage the screwthreads on the neck of capsule 8 without damaging them.

Aligned with a rupturable seal (not shown) on capsule 8 is a hollow needle 14 projecting from a carrier 16 biassed axially by means of a compression spring 18. The carrier is prevented from moving to the left (as viewed) under the action of spring 18 by balls 20 forming part of a detent mechanism. The carrier 16 jams the balls 20 against a shoulder in a flanged sleeve 22 secured to housing 10 by a series of screws 24. The balls 20 are prevented from moving radially inwardly of the sleeve 22 by their engagement with an axially-movable piston member 26 slidably positioned in carrier 16. Piston 26 is biassed to the right, as viewed, by a compression spring 28 seated in a recess 30 within piston 26.

Figure 4:
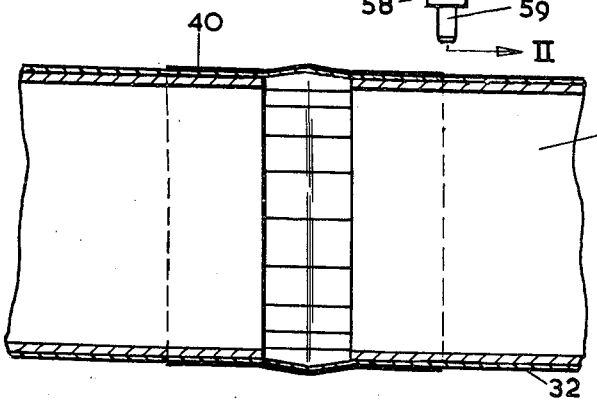
FIG. 4 is a partial sectional view of the collapsible struts shown in FIG. 1, but drawn to a larger scale.

Piston 26 is prevented from moving to the right by means of a circular series of collapsible struts 32 extending between piston 26 and a countermember 34 fixed to a cap 36 secured to the housing 10 by means of a series of pegs 38. As shown more clearly in FIG. 4, the struts 32 are adapted to fold or flex outwardly of the axis of the device when the force leading to this movement, and which is produced by spring 28, exceeds the force restraining this movement. This restraining force is produced by a hoop or band 40 of paper or like material of which the tensile strength reduces drastically when the material becomes wet.

The band 40 may be made up from one or more plies of a thin fibrous material such as cigarette paper. The band has to have sufficient hoop strength when dry to resist the forces exerted on it by the collapsible struts 32. However, when water is admitted to the interior of cap 36, such as by immersion in the sea of the aviator wearing the life jacket fitted with the triggering device of the present invention, the band 40 quickly loses its hoop strength and allows the struts 32 to flex or fold outwardly. The member 34 being fixed, such collapsing of the struts 32 leads to the piston member 26 being allowed to move to the right under the action of spring 28. This movement continues until inwardly-tapering shoulders 42 on piston 26 come to lie beneath the balls 20. When this happens, the balls 20 are moved inwardly by virtue of their contact with the shoulder on sleeve 22 until a position is reached in which the balls 20 are clear of the shoulder and hence allow the carrier 16 to move to the left under the force of spring 18. The rating of spring 18 is chosen so that it is always able to ensure that needle 14 pierces the wall of capsule 8, or at least a rupturable seal forming part of the wall, until a position is reached in which the interior of the capsule is in communication through needle 14 with a chamber 44 in housing 10. This chamber is in turn in communication with a gas outlet 46 connected through a tube 48 (FIG. 1) with gas inlet 4 on life jacket 2. This enables the compressed gas to inflate the life jacket 2, the pressure and volume of gas originally within capsule 8 being chosen so that the life jacket 2 becomes fully inflated without being over-inflated.

The struts 32, in one form of device of the present invention, are formed by milling a circular series of parallel slots in a thinwalled tube of beryllium copper. The slots end short of the end of the tube so that the final configuration is that of two short cylinders integral with several parallel-sided struts extending between the cylinders. After the slots have been milled, each of these struts is creased across its centre so as to form an incipient, outwardly-directed, arch. This biases the strut to flex outwardly when a force is exerted on the cylinder so as to move the cylindrical ends together. The resultant arches cause the struts to depart slightly from being truly cylindrical in shape, but this departure is accommodated easily by the inherent flexibility of the paper or other material forming hoop 40.

The unslotted end portions of the struts 32, and the adjacent portions of the struts, are supported by cylindrical extensions 35 from piston 26 and member 34. These supports take up the strains exerted on the struts while the band 40 is being wound around them.

Although the member 34 is normally fixed relative to cap 36, the connection between the two members allows relative movement when desired. This is achieved by forming a cylindrical rod 48 projecting in opposite directions from member 34 with a peripheral groove in which is seated a circlip 50 or like retaining member. The circlip 50 is kept in position not only by its own resilience but by means of a ring 52 which is a tight fit on rod 48. When it is desired to inflate the life jacket manually, a toggle or other member fitted in opening 54 in the flattened end of rod 48 is moved to the right, as viewed, with sufficient force to allow the rod 48 to move axially, displacing both circlip 50 and ring 52 along the rod. This axial movement of rod 48 is transmitted by the struts 32, which now become ties, so as to move the piston 26 to the right, leading to operation of the device as has already been described.

The triggering device described above will operate within a few seconds of being immersed in water. To prevent the device from being triggered when not desired, the piston 26 has extending from it a tube 58 which is intended to have a pin inserted through it until the pin 59 abuts the inner end face of rod 48. As long as pin 59 is in position, the force exerted by spring 28 is transmitted to the cap 36 other than through the collapsible struts 32. Hence, even if the band 40 becomes weakened, as by exposure to moist air, the device does not trigger, so as to inflate the life-jacket 2, the pin 59 is secured to the wearer's seat (which is preferably of the ejectable type) in such a way that the pin is withdrawn only by the wearer becoming separated from his seat. This separation happens, in an emergency, only when the seat and aircrew member or other person are clear of the aircraft, so that there is no danger of the member becoming trapped in the aircraft by premature inflation of his life-jacket. In a less-preferred alternative, the apertures 56 in cap 36 could be fitted with bungs to prevent water or moisture from entering the cap and weakening hoop 40. The bungs could be similarly connected to the aircrew member's seat so that they would be automatically withdrawn from the apertures 56 when the wearer of the life-jacket becomes separated from his seat. Alternatively, the apertures 56 could be sealed with lightly-loaded non-return valves which would be sufficient to prevent water vapour from passing into the interior of cap 36, but which would be opened by water pressure when the device entered the water. As these devices do not form part of the subject-matter of this invention, they are not described herein in any further detail.

The tube 58 also has another function. In extending from piston 26 it passes through an elongated slot 60 in cap 36. The slot 60, or the respective parts of the member 62 through which tube 58 passes, is formed with a retaining shoulder, so that the tube 58 and shoulder cooperate in the manner of a conventional bayonet-and-slot connection such as is commonly used with domestic electric lamps.

This enables the device to be latched in a position in which the piston 26 cannot move to the right, irrespective of the state of the collapsible struts. When the device is to be "armed" (or rendered operable) the tube 58 is rotated so that it becomes separated from the shoulder and is thereafter free to move axially of slot 60 when allowed to do so by collapsing of struts 32. This necessary angular rotation of piston 26 is accommodated by the collapsible struts, which have sufficient torsional stiffness to ensure that the relatively-fixed support 34 is able to rotate with piston 26, thus rendering the triggering device insensitive to its relative angular position.

The triggering device of the present invention is obviously not limited to use with inflatable life jackets or other flotation devices for the occupants of aircraft. It could also be used on other types of inflatable equipment, or other types of equipment intended to be actuated on immersion in water.

I claim:

1. An immersion-actuated triggering device, including two members resiliently biassed towards each other but held apart by means of two or more folding struts extending between the members and kept in compression by the biassing force, the struts being kept in an elongated position by means of the tensions in one or more pieces of a material of which the tensile strength reduces greatly when it is wetted, whereby the struts collapse by folding outwardly when the material is wetted, the resultant relevant movement of the two members towards each other being effective to trigger an associated mechanism.

2. A device as claimed in claim 1, in which there is a plurality of struts positioned side-by-side and spaced apart from each other along a closed curve, the struts being embraced intermediate their ends by a hoop of the said material, the said intermediate portions of the struts being biassed to move outwardly by the compressive forces in the struts, the hoop resisting such movement until its tensile strength is reduced significantly.

3. A device as claimed in claim 1, in which each strut is in the form of a strip of thin, flexible, material having at its centre a transverse crease forming an incipient, outwardly-directed, arch.

4. A device as claimed in claim 3, in which the struts are made from the same piece of material substantially in the shape of a tube or cylinder, with the struts being defined by parallel, closed-ended, slots through the wall of the tube or cylinder.

5. A device as claimed in claim 3, in which each end of each strut is supported by a relatively-rigid member disposed inwardly thereof, and in which each end of each strut is forced into contact with its support member by means of the tension in the said material.

6. A device as claimed in claim 1, in which one of the said members is connected to an apertured cap enclosing the said device and secured to a housing, and in which the other of the said members is arranged so that movement thereof towards the said one member causes a hollow needle to pierce through the wall of a capsule of pressurised fluid when the capsule is appropriately secured to the said housing, and an inflatable body in communication with the interior of the said housing and being adapted to receive fluid vented from the capsule through the needle.

7. A device as claimed in claim 6, in which the said needle is carried by a carrier biassed for movement along the axis of the said housing towards a receptacle for the neck of a capsule of pressurised fluid, the carrier being prevented from moving under the action of its bias by a detent mechanism adapted to be released by axial movement of said other member upon collapse of the struts.

8. A device as claimed in claim 6, in which the said other member has projecting sideways from it a member which is adapted to form a bayonet-and-slot connection with the cap or housing of the device.

9. A device as claimed in claim 8, in which the said projecting member is hollow and is adapted to receive a slidable pin of which the inner end is effective to transmit to the said one member of the collapsible struts device the axial force which would otherwise be applied to the collapsible struts, whereby removal of the pin renders the triggering device operable.

10. A device as claimed in claim 1, including means for applying tension to the struts to move them bodily along their axes to effect triggering movement of one of the said two members.

* * * * *